US007853171B2

(12) United States Patent
Matsui

(10) Patent No.: US 7,853,171 B2
(45) Date of Patent: Dec. 14, 2010

(54) DEVELOPING APPARATUS AND IMAGE FORMING APPARATUS PROVIDED THEREWITH

(75) Inventor: Kenshi Matsui, Higashiosaka (JP)

(73) Assignee: Kyocera Mita Corporation (JP)

( * ) Notice: Subject to any disclaimer, the term of this patent is extended or adjusted under 35 U.S.C. 154(b) by 160 days.

(21) Appl. No.: 12/233,786

(22) Filed: Sep. 19, 2008

(65) Prior Publication Data

US 2009/0103956 A1 Apr. 23, 2009

(30) Foreign Application Priority Data

Sep. 27, 2007 (JP) ..... 2007-251335

(51) Int. Cl.
*G03G 21/00* (2006.01)

(52) U.S. Cl. ..... 399/99; 399/120

(58) Field of Classification Search ..... 399/99, 399/107, 119, 120, 252, 264, 265, 279, 281, 399/284, 286
See application file for complete search history.

(56) References Cited

U.S. PATENT DOCUMENTS

| | | | | |
|---|---|---|---|---|
| 7,555,256 | B2 * | 6/2009 | Ogawa et al. | 399/359 |
| 2003/0148203 | A1 * | 8/2003 | Suzuki et al. | 430/110.3 |
| 2008/0199234 | A1 * | 8/2008 | Hagi et al. | 399/359 |
| 2008/0205941 | A1 * | 8/2008 | Sakai | 399/273 |

FOREIGN PATENT DOCUMENTS

| | | |
|---|---|---|
| JP | H02-210472 | 8/1990 |
| JP | H07-319279 | 12/1995 |

* cited by examiner

*Primary Examiner*—Hoan Tran
(74) *Attorney, Agent, or Firm*—Ostrolenk Faber LLP

(57) ABSTRACT

A developing apparatus is provided with: a developing roller; and a recovering roller that is arranged so as to oppose the developing roller, recovers scattered toner, and stores negatively chargeable toner, wherein the recovering roller has its surface coated with a fluorine resin or a silicone resin, and is provided with a blade that removes the scattered toner, and a difference (A−C) between a work function (A) of the resin and a work function (C) of the blade is greater than or equal to 0.10 eV.

8 Claims, 2 Drawing Sheets

DEVELOPING APPARATUS AND IMAGE FORMING APPARATUS PROVIDED THEREWITH

Priority is claimed on Japanese Patent Application No. 2007-251335, filed on Sep. 27, 2007, the contents of which are incorporated herein by reference.

BACKGROUND OF THE INVENTION

1. Field of the Invention

The present invention relates to a developing apparatus and an image forming apparatus provided therewith.

2. Description of the Related Art

An image forming apparatus that uses electrophotography such as a photocopier and a printer is provided with a developing apparatus that stores toner therein. When a developing roller in this developing apparatus has moved to a position opposing a photoreceptor drum, an electrostatic latent image is developed on the photoreceptor drum, and a toner image is formed on the photoreceptor drum.

In such a developing apparatus, the toner electrification performance is likely to decrease due to degradation of the toner and environmental changes. Consequently the toner is likely to be scattered from the developing roller. If the scattered toner scattered from the developing roller is attached on the photoreceptor drum, then it is transferred together with the toner image, and a reduction of the image quality becomes more likely as a result.

As a method for recovering scattered toner, for example Japanese Unexamined Patent Application, First Publication No. H02-210472 (hereunder, referred to as Patent Document 1) discloses a developing apparatus provided with a recovering device that is arranged so as to oppose a sleeve (developing roller). According to the technique disclosed in Patent Document 1, a conductive roller is used as a recovering device, and by applying a bias voltage to this conductive roller, scattered toner is recovered.

In Japanese Unexamined Patent Application, First Publication No. H07-319279 (hereunder, referred to as Patent Document 2), there is disclosed a developing apparatus provided with; a toner recovering roller in close proximity to a developing roller, a frictional electrification device that comes in contact with the surface of this toner recovering roller, and a toner detaching device that removes toner that has been attached onto the roller surface of the toner recovering roller. According to Patent Document 2, by contact-charging the toner recovering roller and the toner detaching device, scattered toner recovery efficiency is increased.

Accordingly, in the developing apparatuses according to Patent Documents 1 and 2, a metallic roller is used as a roller (recovering roller) for recovering scattered toner, and a bias voltage is applied thereto to thereby make the recovering roller more likely to attract scattered toner and improve scattered toner recovery efficiency.

However, in the method of recovering scattered toner with a bias voltage applied to a metallic recovering roller, as with the developing apparatuses according to Patent Documents 1 and 2, the van der Waals' force that acts between the recovering roller and the scattered toner is significant, and therefore the force of attracting scattered toner to the recovering roller is significant.

Consequently, once scattered toner has been attracted to and attached onto the recovering roller, it is difficult to remove the scattered toner even with a cleaning member attached to the recovering roller. When the image forming apparatus has been operated for a long period of time, the entire surface of the recovering roller becomes coated with scattered toner, and the van der Waals' force that acts between the recovering roller and the scattered toner is likely to be reduced. As a result, the recovering roller becomes unlikely to attract scattered toner, and the performance of scattered toner recovery of the recovering roller is likely to be reduced.

The present invention takes the above circumstances into consideration, with an object of providing a developing apparatus capable of recovering scattered toner for a long period of time without reducing recovering performance, and an image forming apparatus provided therewith.

SUMMARY OF THE INVENTION

A developing apparatus of the present invention is provided with; a developing roller; and a recovering roller that is arranged so as to oppose the developing roller, recovers scattered toner, and stores negatively chargeable toner, wherein the recovering roller has its surface coated with a fluorine resin or a silicone resin, and is provided with a blade that removes the scattered toner, and a difference (A−C) between a work function (A) of the resin and a work function (C) of the blade is greater than or equal to 0.10 eV.

The developing apparatus of the present invention may be provided with; a developing roller; and a recovering roller that is arranged so as to oppose the developing roller, recovers scattered toner, and stores positively chargeable toner, wherein the recovering roller has its surface coated with an acrylic resin or a silicone resin, and is provided with a blade that removes the scattered toner, and a difference (B−C) between a work function (B) of the resin and a work function (C) of the blade is less than or equal to −0.10 eV.

In the developing apparatus according to the present invention, the blade may be made from urethane resin.

In the developing apparatus according to the present invention, a bias voltage having a polarity the same as that of the toner stored in the developing apparatus may be applied to the recovering roller.

An image forming apparatus may be provided with the developing apparatus according to the present invention.

According to the developing apparatus and the image forming apparatus provided therewith of the present invention, scattered toner can be recovered for a long period of time without reducing recovery performance.

DETAILED DESCRIPTION OF THE INVENTION

Hereunder the present invention is described in detail, with reference to the drawings.

[Developing Apparatus]

Figure 1:
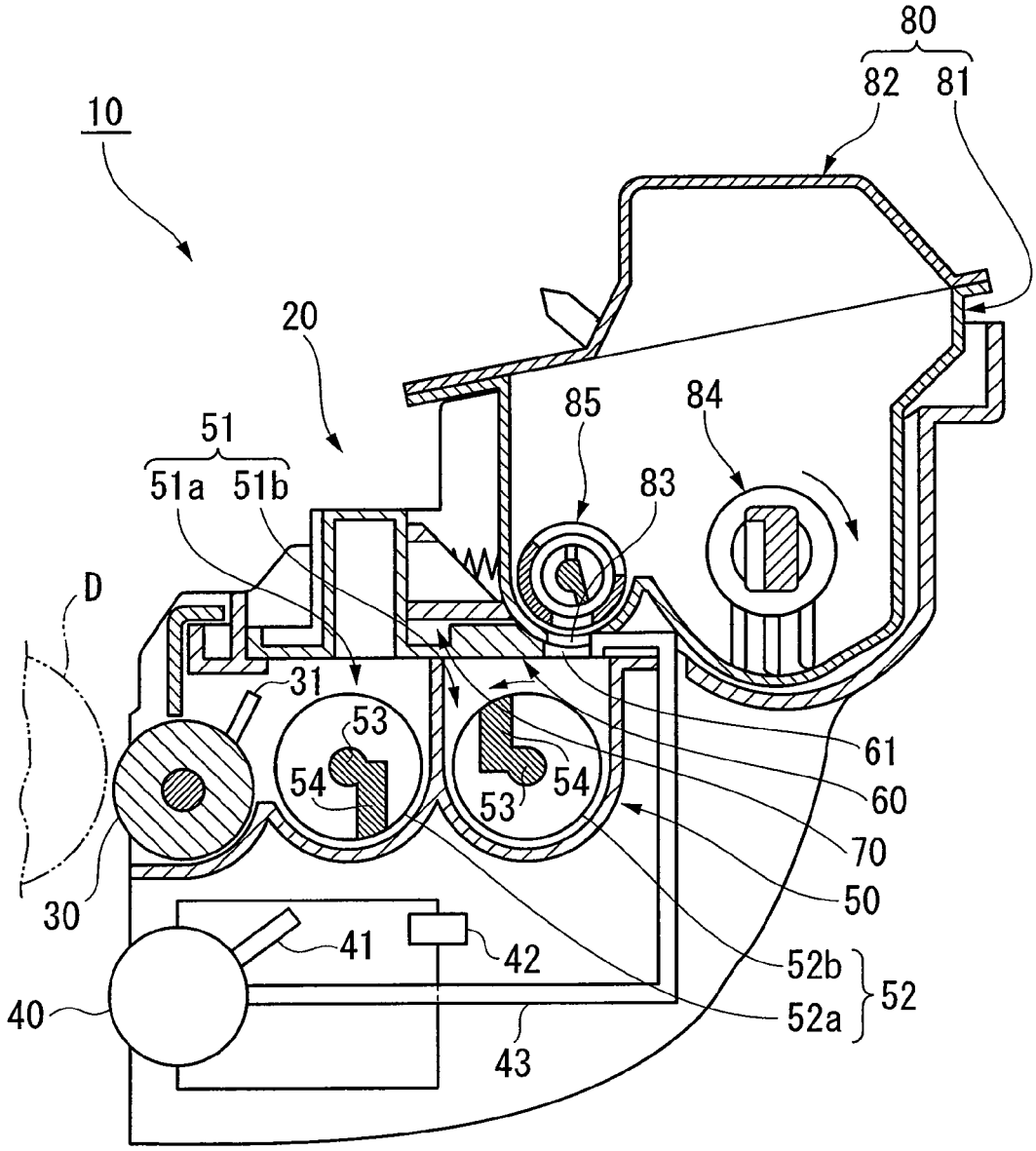
FIG. 1 is a schematic drawing showing an embodiment of a developing apparatus of the present invention.

FIG. 1 is a schematic diagram of a developing apparatus according to an embodiment of the present invention. A developing apparatus 10 of the present embodiment, in order to supply toner onto the circumferential face of a photoreceptor drum D, is provided with a developing apparatus main unit (apparatus main unit section) 20 provided adjacent to the photoreceptor drum D, and a toner cartridge (developer supply section) 80 that is detachably attached to the developing apparatus main unit 20 and replenishes toner.

The developing apparatus main unit 20 is provided with a developing roller 30, and a recovering roller 40 arranged opposing the developing roller 30.

For the developing roller 30, there is provided a blade 31, and the layer thickness of toner attached to the surface of the developing roller 30 is adjusted by this blade 31. The preferable material for the blade 31 is a urethane resin.

A recovering roller 40 recovers scattered toner scattered from the developing roller 30, and has a surface coated with a resin. The material of the recovering roller 40 is not particularly limited. However, it would be useful when applying bias voltage if the recovering roller 40 were made of a metallic material such as aluminum.

For the recovering roller 40 there is provided a blade 41, and scattered toner attached to the surface of the recovering roller 40 is removed by this blade 41. Specific examples of the material for the blade 41 include urethane resin, fluorine resin, and silicone resin, and urethane resin is preferable among these materials.

The surface of the recovering roller 40 is coated with a resin, thereby appropriately suppressing the van der Waals' force acting between the recovering roller 40 and the scattered toner. Hence the scattered toner attached to the recovering roller 40 can be easily removed by the blade 41.

As a coating method, for example a well known method such as spray-drying may be employed.

When coating the surface of the recovering roller 40 with a resin, it is preferable that coating be performed to give a thickness of approximately 5 μm to 30 μm thickness for example. As long as the thickness is greater than or equal to 5 μm, it is possible to further reduce the van der Waals' force that acts between the recovering roller 40 and the scattered toner. On the other hand, if the thickness is less than or equal to 30 μm, the attachment force of scattered toner becomes sufficient.

As the resin mentioned above, a fluorine resin or silicone resin (a) is used in the case where the toner to be stored in the developing apparatus is negatively charged. Among these, fluorine resin (a) having low surface energy is preferable and enables further suppression of the van der Waals' force, and the scattered toner can be removed more easily with the blade 41.

The above resin (a) is such that the difference (A−C) between a work function (A) of the resin (a) and a work function (C) of the blade 41 is greater than or equal to 0.10 eV, and more preferably 0.15 eV to 0.40 eV.

Here, the work function means the minimum ultraviolet light irradiation energy required for emitting a single photoelectron from the surface of a substance, and for example, it can be obtained using a photoelectron spectrometer "AC-1" manufactured by Riken Keiki Co., Ltd.

As a result of earnest investigation, the present inventors focused their attention on the fact that the toner stored in the developing apparatus that had been degraded and consequently inverse-charged, was the primary constituent of the scattered toner. Consequently, they have found that if the surface of the recovering roller 40 is coated with a resin having a polarity the same as that of the toner stored in the developing apparatus, then by contacting with the surface of the recovering roller 40 and rubbing on the blade 41, the surface of the recovering roller 40 is charged with a polarity opposite to that of the scattered toner, and the scattered toner is attracted thereto.

In the case where the toner stored in the developing apparatus is negatively charged, if the surface of the recovering roller 40 is coated with a fluorine resin having negative polarity, then the surface of the recovering roller 40 becomes more likely to be negatively charged by rubbing on the blade 41. If the difference in the work functions (A−C) is greater than or equal to 0.10 eV, electrons of the blade 41 are likely to shift to the side of the recovering roller 40 with the surface coated with a fluorine resin, so that the surface of the recovering roller 40 is sufficiently charged negative. Therefore it becomes likely to attract positively charged scattered toner, and the performance of scattered toner recovery is improved.

The fluorine resin is not particularly limited, as long as it results in the above mentioned difference in the work functions (A−C) greater than or equal to 0.10 eV. Specific examples of the fluorine resin include polymers or copolymers such as vinylidene fluoride, tetrafluoroethylene, hexafluoropropylene, monochlorotrifluoroethylene, monochloroethylene, and trifluoroethylene. Among these resins, tetrafluoroethylene is preferable.

A silicone resin is a nonpolar resin, however its work function range is wide. Therefore, it can be used as an equivalent to a negatively charged resin or positively charged resin, depending on the type of the silicone resin.

Specific examples of the silicone resin that result in a work function difference (A−C) greater than or equal to 0.10 eV include straight silicone, fluorine-modified silicone, and RTV silicone. Among these resins, straight silicone is preferable. A commercially available silicone resin may be used, and for example, straight silicone "SR2406" manufactured by Dow Corning Toray Co., Ltd. or the like is suitable.

As mentioned above, in the case where the toner stored in the developing apparatus is negatively charged, by coating the recovering roller 40 with a fluorine resin or silicone resin (a), the scattered toner becomes likely to be attached onto the recovering roller 40, and hence the recovering performance is improved. Meanwhile, the van der Waals' force that acts between the recovering roller 40 and the scattered toner is suppressed, and removal of the scattered toner with the blade 41 becomes more likely. Therefore, scattered toner can be recovered for a long period of time while maintaining the recovering performance at a high level.

On the other hand, in the case where the toner stored in the developing apparatus is positively charged, an acrylic resin or silicone resin (b) is used as the resin mentioned above.

In the above resin (b) the difference (B−C) between a work function (B) of the resin (b) and the work function (C) of the blade 41 is less than or equal to −0.10 eV, and more preferably −0.15 eV to −0.40 eV.

In the case where the toner stored in the developing apparatus is positively charged, if the surface of the recovering roller 40 is coated with an acrylic resin having positive polarity, the surface of the recovering roller 40 becomes more likely to be positively charged by rubbing on the blade 41. If the difference in the work functions (B−C) is less than or equal to −0.10 eV, then electrons of the acrylic resin coated on the surface of the blade 41 are likely to shift to the blade side, and the surface of the recovering roller 40 is sufficiently charged positive. Therefore it becomes likely to attract negatively charged scattered toner, and the performance of scattered toner recovery is improved.

The acrylic resin is not particularly limited, as long as it results in the above mentioned difference in the work functions (B−C) less than or equal to −0.10 eV. Specific examples of the acrylic resin include polymethyl methacrylate, methyl methacrylate, and butyl methacrylate. Among these resins, polymethyl methacrylate is preferable.

A silicone resin is a nonpolar resin, however its work function range is wide as mentioned above. Therefore, it can be used as an equivalent to a negatively charged resin or positively charged resin, depending on the type of the silicone resin.

Specific examples of the silicone resin that result in a work function difference (B−C) less than or equal to −0.10 eV include straight silicone, fluorine-modified silicone, and RTV silicone. Among these resins, straight silicone is preferable. A commercially available silicone resin may be used, and for example, straight silicone "AY42-170" manufactured by Dow Corning Toray Co., Ltd. or the like is suitable.

As mentioned above, in the case where the toner stored in the developing apparatus is positively charged, by coating the recovering roller 40 with an acrylic resin or silicone resin (b), the scattered toner becomes likely to be attached onto the recovering roller 40, and hence the recovering performance is improved. Meanwhile, the van der Waals' force that acts between the recovering roller 40 and the scattered toner is suppressed, and removal of the scattered toner with the blade 41 becomes more likely. Therefore, scattered toner can be recovered for a long period of time while maintaining the recovering performance at a high level.

To the recovering roller 40 there may be attached a bias power supply 42. In this case, by applying a bias voltage from the bias power supply 42 to the recovering roller 40, performance of scattered toner recovery can be further improved.

When applying a bias voltage, a bias voltage having a polarity the same as that of the toner stored in the developing apparatus is applied.

It is preferable that in the recovering roller 40 there be provided a circulating device 43 that circulates the recovered scattered toner within a housing described later.

In this case, the scattered toner recovered by the recovering roller 40 is removed from the recovering roller 40 by the blade 41 due to the rotation of the recovering roller. The scattered toner that has been removed is captured by a capturing member (not shown in the drawing) provided in the circulating device 43, and travels through the circulating device 43 and is supplied into the housing 50.

Thus, by providing the circulating device 43, the scattered toner can be reused.

In addition to the developing roller 30 and the recovering roller 40 mentioned above, the developing apparatus main unit 20 of the present invention is provided with: the housing 50 having a circulation transport passage 51 that circulates/transports the toner therein; a lid 60 that closes an upper face opening of the housing 50; and a lid side shutter member 70 attached to the lid 60 for opening/closing a toner inlet 61 formed in the lid 60. The lid 60 with the lid side shutter member 70 attached thereto is fixed to the housing 50.

The circulation transport passage 51 is provided with; a front transport passage 51*a* that is formed on the front side so as to be long in the crosswise direction, and a rear transport passage 51*b* that is formed on the rear side of the front transport passage 51*a* in parallel with the front transport passage 51*a*, and it has a pair of spiral feeders (transport devices) 52 attached thereto. These spiral feeders 52 comprise a front spiral feeder 52*a* attached to the front transport passage 51*a* and a rear spiral feeder 52*b* attached to the rear transport passage 51*b*.

The front and rear spiral feeders 52*a* and 52*b* are respectively provided with a feeder shaft 53 and a spiral fin 54 spirally formed around the feeder shaft 53. The spiral fin 54 and the feeder shaft 53 integrally rotate together about the axis, thereby circulating and transporting the toner loaded inside the circulation transport passage 51.

The above mentioned developing roller 30 is positioned on the front side of the front transport passage 51*a*. The front transport passage 51*a* and the portion where the developing roller 30 is provided communicate with each other throughout the substantially entire crosswise direction length. Moreover, the installation position of the developing roller 30 is set so that its circumferential face opposes the circumferential face of the photoreceptor drum D. Therefore, the toner transported through the front transport passage 51*a* is supplied onto the circumferential face of the photoreceptor drum D via the developing roller 30, and a toner image is thereby formed on the circumferential face of the photoreceptor drum D.

The lid 60 is provided with a flat plate shaped lid main body (not shown in the drawing). This lid main body is such that the planar dimension thereof is set so as to be slightly greater than that of the upper face opening of the housing 50. Consequently, by placing the lid main body over the upper face of the housing 50, the upper face of the circulation transport passage 51 is closed. In the lid 60 there is provided the toner inlet 61 for loading toner from the toner cartridge 80 into the housing 50. The lid side shutter member 70 opens/closes the toner inlet 61.

The above mentioned circulating device 43 is connected to the toner inlet 61 so that the recovered scattered toner is appropriately loaded, together with unused toner stored in the toner cartridge 80, from the toner inlet 61 into the housing 50 and is further circulated through the circulation transport passage 51, and is thereby charged positive.

The toner cartridge 80 is provided with a cartridge main unit 81 in which toner is loaded, and a cover 82 that closes the upper face opening of the cartridge main unit 81.

The toner cartridge 80 is provided with a toner discharge outlet 83 pierced therethrough so as to oppose the toner inlet 61 of the lid 60, and in the state where the toner cartridge 80 is attached to the housing 50, the toner in the toner cartridge 80 is supplied into the housing 50 through the toner discharge outlet 83 and the toner inlet 61 of the lid 60.

The toner cartridge 80 is provided with an agitating member 84 that scrapes off the toner, and a cartridge side shutter member 85. The agitating member 84 and the cartridge side shutter 85 synchronous-rotate to thereby transport the toner toward the toner discharge outlet 83.

<Toner>

The toner to be stored in the above mentioned toner cartridge 80 is not particularly limited. However, for example, the toner to be used may be one where a coloring agent, a charge control agent, a releasing agent, or the like are dispersed in a binder resin and granulated, and an electrification control agent, a flow improving agent, or the like are externally added as desired.

Specific examples of the binder resin include thermoplastic resin and thermosetting resin, for example vinyl aromatic resin such as polystyrene, styrene-acrylic copolymer, acrylic resin, polyvinyl acetal resin, polyester resin, epoxy resin, and phenol resin.

The charge control agent controls the electric charge amount of the toner. Specific examples of a positively chargeable charge control agent include nigrosine-base and quaternary ammonium salt. Specific examples of a negatively chargeable charge control agent include metal complex dye, salicylic acid derivative, and sulfonic acid derivative.

In the case where a part of the charge control effect is to be performed by the binder resin without use of the charge control agent, a resin having an anionic or cationic polar group is used as a part of the binder resin. Specific examples of the cationic polar group include a basic nitrogen containing group such as a primary, secondary, and tertiary amino group, a quaternary ammonium group, an amide group, an imino group, an imido group, a hydrazino group, a guanidino group, and an amidino group. Specific examples of the anionic polar group include polar groups such as carboxylic acid, sulfonic acid, and phosphonic acid.

Thus, by appropriately selecting the charge control agent to be compounded, the chargeability of the toner can be adjusted to positive or negative.

Specific examples of the coloring agent, for example as a black pigment, include carbon black pigments such as acetylene black pigment, lamp black, and aniline black. Specific examples of a yellow pigment include chrome yellow, zinc yellow, cadmium yellow, yellow oxide, mineral fast yellow, nickel titanium yellow, naples yellow, naphthol yellow S, hansa yellow G, hansa yellow 10G; benzidine yellow G, benzidine yellow GR, quinoline yellow lake, permanent yellow NCG, and tartrazine lake. Specific examples of an orange pigment include chrome orange, molybdenum orange, permanent orange GTR, pyrazolone orange, vulcan orange, indusren brilliant orange RK, benzidine orange G, and indusren brilliant orange GK. Specific examples of a red pigment include colcothar, cadmium red, red lead, mercuric sulfide cadmium, permanent red 4R, lithol red, pyrazolone red, watching red calcium salt, lake red D, brilliant carmin 6B, eosin lake, rhodamine lake B, alizarin lake, and brilliant carmin 3B. Specific examples of a purple pigment include manganese purple, fast violet B, and methyl violet lake. Specific examples of a blue pigment include iron blue, cobalt blue, alkali blue lake, victoria blue lake, phthalocyanine blue, metal-free phthalocyanine blue, phthalocyanine blue partial chloride, fast sky blue, and indusren blue BC. Specific examples of a green pigment include chrome green, chrome oxide, pigment green B, malachite green lake, and final yellow green G. Specific examples of a white pigment include zinc white, titanium oxide, antimony white, zinc sulfide, baryta powder, barium carbonate, clay, silica, white carbon, talc, and alumina white.

Specific examples of the releasing agent include various kinds of natural waxes, and synthetic wax such as polyolefin wax. The number average molecular weight (Mn) of polyolefin wax is preferably 1,000 to 10,000, and more preferably 2,000 to 6,000. Specific examples of polyolefin include polypropylene, polyethylene, propylene-ethylene copolymer, and polypropylene is preferable.

An external additive may be added to the toner as required. Specific examples of the external additive include silica, titanium oxide, inorganic oxide such as alumina, and metal soap such as calcium stearate.

The toner may be combined with a carrier to be used as a two component developing agent, or may be independently used as a one component developing agent. Commonly known carriers such as magnetic particles and resin particles in which magnetic bodies are dispersed in a binder resin can be used.

[Image Forming Apparatus]

The developing apparatus of the present invention can be preferably used as a developing apparatus installed in an image forming apparatus that uses electrophotography.

Figure 2:
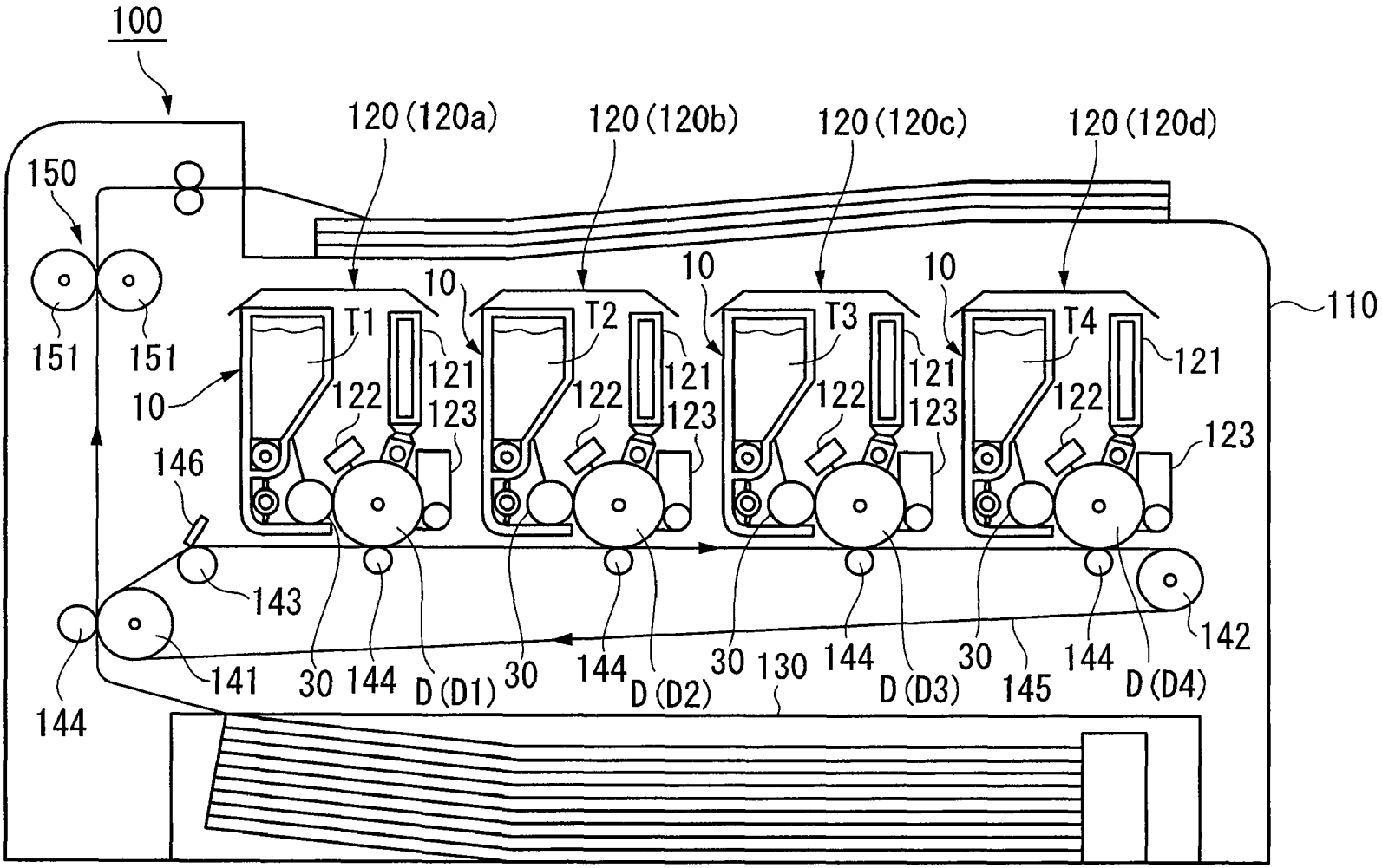
FIG. 2 is a schematic drawing showing an embodiment of an image forming apparatus of the present invention.

Here, with reference to FIG. 2, an embodiment of an image forming apparatus provided with the developing apparatus of the present invention is described. An image forming apparatus 100 of this example is an indirect transferring tandem type color image forming apparatus in which four photoreceptor drums D are arranged on an intermediate transferring belt (intermediate transferring unit).

As shown in FIG. 2, in a housing 110 of this image forming apparatus 100, there is arranged an intermediate transferring belt 145 that is tensioned and travels around rollers 141, 142, and 143. Above this intermediate transferring belt 145 there are four image forming units 120 (120*a*, 120*b*, 120*c*, and 120*d*) arranged in the order of toner image transferring (sequentially from the upstream side).

The image forming unit 120 has a structure such that the above mentioned developing apparatus 10, and a charging device 121, an exposure device 122, and a cleaning device 123 are respectively arranged around photoreceptor drums D (D1, D2, D3, and D4). In a tandem type image forming apparatus, it is important to design these components in a compact size. These photoreceptor drums D are sequentially arranged along the moving direction of the intermediate transferring belt 145.

In each developing apparatus 10, there are respectively stored a toner T1 (magenta toner), a toner T2 (cyan toner), a toner T3 (yellow toner), and a toner T4 (black toner).

Next, an image forming process of the image forming apparatus 100 is generally described. Taking the image forming unit 120*a* as an example, at first the surface of the photoreceptor drum D1 is uniformly charged positive by the charging device 121. Subsequently, the exposure device 122 forms an electrostatic latent image on the surface of the photoreceptor drum D1.

In the developing apparatus 10, toner is sequentially supplied onto the developing roller 30, and an image layer is formed on the developing roller 30. The toner of the developing roller 30 is transported by the counterclockwise rotation of the developing roller 30 to a position (developing unit) opposing the photoreceptor drum D1. At this time, the amount of the toner is controlled by the blade 31 (refer to FIG. 1) while the toner T1 is given frictional electrification. This charged toner T1 is attached onto an electrostatic latent image on the photoreceptor drum D1, and the electrostatic latent image is visualized (developed), forming a toner image. An electrostatic latent image on the photoreceptor drums D2, D3, and D4 is visualized in other image forming units 120*b*, 120*c*, and 120*d* in a manner the same as that described above, and toner images are thereby formed.

The toner image visualized on the photoreceptor drums D1, D2, D3, and D4 is sequentially transferred from the photoreceptor drum D1 on the upstream side onto the surface of the intermediate transferring belt 145. A full color image transferred onto this intermediate transferring belt 145 is transferred onto a transfer paper (recording material) that has been transported from a paper feeding cassette 130 to between the roller 141 and a transferring roller 144. The toner on the intermediate transferring belt 145 that has not been transferred is removed by a cleaning device 146. The full color image that has been transferred onto the transfer paper is subjected to heat and pressure and fused on the transfer paper in a fusing device 150 provided with a pair of fuser rollers 151, and then this transfer paper is discharged to the upper side of the housing 110.

On the other hand, the scattered toner scattered from the developing roller 30 is recovered by the recovering roller 40 (refer to FIG. 1) installed on the developing apparatus 10. At this time, if a bias voltage having a polarity the same as that of the toner stored in the developing apparatus is applied to the recovering roller, then the efficiency of recovering the scattered toner can be improved. As a result the scattered toner is suppressed from being attached onto the photoreceptor drum D, and hence transfer of the scattered toner can be prevented, while reducing a reduction in image quality.

The method of visualizing an electrostatic latent image on each of the photoreceptor drums may be either a positive developing method or a reversal developing method. Moreover the developing method may be either a contact developing method in which a developing agent layer and the photoreceptor drum come in contact with each other, or a jumping developing method in which the developing agent layer and the photoreceptor drum do not come in contact with each other. From a viewpoint of obtaining a high quality image, the negative image developing method is preferable. In this case, the photoreceptor drum is charged with a polarity the same as that of the toner, and the electric charge of the latent image portion is removed in exposure. In the developing unit, an alternating voltage serving as a developing bias, in which an alternating current is superposed on a direct current, is applied between a developing sleeve and the photoreceptor drum. As a result the toner in the developing agent is transferred to and attached onto the electrostatic latent image on the photoreceptor drum which has had its electric charge removed, and is thereby visualized as a toner image.

The material for the photoreceptor drum that may be used in the present invention is not particularly limited, and a conventionally known material may be used. Specific examples of the photoreceptor drum material include photoreceptors such as an amorphous silicon photoreceptor, an organic photoreceptor, a Se photoreceptor, a ZnO photoreceptor, and a CdS photoreceptor. Among these photoreceptors, the amorphous silicon photoreceptor is preferable from the viewpoint of durability.

In the above embodiment, a case where each of the image forming units is provided with an exposure device has been described. However an integrated multi-beam laser exposure device that is provided, outside the image forming unit, with an exposure unit for an individual photoreceptor may be used.

The image forming apparatus of the present invention is not limited to the one described above, and for example, a color image forming apparatus of a system (direct transferring tandem type) that does not have an intermediate transferring unit and sequentially repeats direct transferring from photoreceptor drums onto a recording material, may be provided with the developing apparatus of the present invention.

As described above, according to the present invention, by coating the surface of the recovering roller that recovers scattered toner, with a specific type of resin, the recovering roller becomes more likely to attract scattered toner and the performance of recovery is thereby improved. Meanwhile, since the van der Waals' force that acts between the recovering roller and the scattered toner is suppressed, the scattered toner attached on the recovering roller can be easily removed with the blade, and scattered toner can be recovered for a long period of time.

WORKING EXAMPLE

Hereunder, the present invention is specifically described with working examples.

[Manufacturing of Toner]

<Manufacturing Positively Chargeable Toner>

2 parts by mass of 2,2-azobis (2,4-dimethylvaleronitrile) as a polymerization initiator was added to a mixed solution of: 80 parts by mass of styrene; 20 parts by mass of 2-ethylhexyl methacrylate; 5 parts by mass of cyan pigment (C. I. pigment blue 15:3) as a coloring agent; 3 parts by mass of low molecular weight polypropylene; 2 parts by mass of quaternary ammonium salt compound ("P-51" manufactured by Orient Chemical Industries, Ltd.) as a charge control agent; and 1 part by mass of divinylbenzene as a cross linking agent, and these were added to 400 parts by mass of purified water, and then 5 parts by mass of tribasic calcium phosphate as a suspension stabilizer and 0.1 parts by mass of sodium dodecylbenzenesulfonate were added thereto. Then these were agitated at 7000 rpm for 20 minutes using a TK homomixer (manufactured by Tokushu Kika Kogyo Co., Ltd.) and were subjected to a polymerization reaction at 70° C. and at 100 rpm for 10 hours under a nitrogen atmosphere, to obtain fine particles of 6.3 μm volume mean particle diameter. 1.5 parts by mass of hydrophobic silica fine powder was added to these fine particles, and these were mixed using a Henschel mixer (manufactured by Mitsui Mining. Co., Ltd.) to obtain positively charged cyan toner of 6.3 μm volume mean particle diameter. The volume mean particle diameter was measured on a multimizer III (manufactured by Coulter Counter, Inc.

<Manufacturing Negatively Chargeable Toner>

Except for 2 parts by mass of negatively chargeable charge control agent ("E-84" manufactured by Orient Chemical Industries, Ltd.) being used as a charge control agent instead of quaternary ammonium salt compound, negatively chargeable cyan toner was manufactured in the manner same as that of the positively chargeable toner. The volume mean particle diameter of the cyan toner was 6.5 μm.

[Various Measurements]

<Measuring Work Function>

The work functions of the resin to be coated on the surface of the recovering roller and of the blade provided on the recovering roller were measured using a photoelectron spectrometer ("AC-1" manufactured by Riken Keiki Co., Ltd.) under the conditions: temperature 20° C., humidity 60%.

<Measuring Attachment Force of Scattered Toner>

The attachment force of scattered toner on the recovering roller was measured using an inter-microparticle attachment force device ("PAF-300N" manufactured by Okada Seiko Co., Ltd.) under the conditions: temperature 20° C., humidity 60%.

Examination 1

Working Example 1-1

A developing apparatus having a structure shown in FIG. 1 was used. As for an image forming apparatus, a modified printer (LS-C8026) manufactured by Kyocera Mita Corporation was used, and the above developing apparatus was attached thereon, and the previously obtained negatively chargeable toner was stored in the developing apparatus.

As for the recovering roller, an aluminum made metallic roller was used, and the surface was coated with a fluorine resin ("DL-902" manufactured by Du Pont-Mitsui Fluorochemicals Company, Ltd.) by means of spray-drying. In order to improve the recovery efficiency, a DC bias voltage (−500V) having a polarity (negative) the same as that of the toner was applied, and the recovering roller was rotated at 10 rpm. The recovering roller was provided with a urethane blade. The work function of this blade was 5.5 eV.

With use of the above image forming apparatus, an endurance test of 10,000 printings was carried out.

Scattered toner attached on the intermediate transferring belt was measured at every 2,000 printings, and this measurement was taken as a scattered toner amount.

The cleaning performance for when the blade removed scattered toner attached on the recovering roller was visually evaluated, and "Good" was recorded when the cleaning performance was excellent, while "Bad" was recorded when the cleaning performance was bad.

For the scattered toner recovery performance of the recovering roller, a case where, after performing the endurance test of 10,000 printings, a cumulative total amount of scattered toner was less than or equal to 1.0 g was determined as excellent and recorded as "Good", and a case where a cumulative total exceeded 1.0 g was determined as bad and recorded as "Bad".

The respective evaluation results are shown in Table 1.

Working Example 1-2

Except for using a silicone resin ("SR2406" manufactured by Dow Corning Toray Co., Ltd.) as the resin shown in Table 1, an endurance test was carried out as with the working example 1-1, and a scattered toner amount was obtained to evaluate cleaning performance and scattered toner recovery performance. The results are shown in Table 1.

Comparative Example 1-1

Except for not coating the surface of the recovering roller with a resin, an endurance test was carried out as with the working example 1-1, and a scattered toner amount was obtained to evaluate cleaning performance and scattered toner recovery performance. The results are shown in Table 1.

Comparative Example 1-2

Except for using an acrylic resin ("Almatex" manufactured by Mitsui Chemicals, Inc.) as the resin shown in Table 1, an endurance test was carried out as with the working example 1-1, and a scattered toner amount was obtained to evaluate cleaning performance and scattered toner recovery performance. The results are shown in Table 1.

Comparative Example 1-3

Except for using a silicone resin ("SR2510" manufactured by Dow Corning Toray Co., Ltd.) as the resin shown in Table 1, an endurance test was carried out as with the working example 1-1, and a scattered toner amount was obtained to evaluate cleaning performance and scattered toner recovery performance. The results are shown in Table 1.

TABLE 1

| | | Working examples | | Comparative examples | | |
|---|---|---|---|---|---|---|
| | | 1-1 | 1-2 | 1-1 | 1-2 | 1-3 |
| Resin | | Fluorine resin | Silicone resin | — | Acrylic resin | Silicone resin |
| Work function (A) of resin (eV) | | 5.7 | 5.8 | 4.7 | 5.3 | 5.5 |
| Work function (C) of blade (eV) | | 5.5 | 5.5 | 5.5 | 5.5 | 5.5 |
| Difference in work functions (A − C) (eV) | | 0.2 | 0.3 | −0.8 | −0.2 | 0.0 |
| Attachment force of scattered toner (nN) | | 5 | 5 | 60 | 5 | 5 |
| Scattered toner amount (g) | 0 printings | 0.0 | 0.0 | 0.0 | 0.0 | 0.0 |
| | 2,000 printings | 0.2 | 0.0 | 0.2 | 1.9 | 1.8 |
| | 4,000 printings | 0.1 | 0.1 | 0.8 | 2.1 | 1.2 |
| | 6,000 printings | 0.0 | 0.0 | 1.4 | 1.8 | 1.9 |
| | 8,000 printings | 0.0 | 0.2 | 2.9 | 2.2 | 2.7 |
| | 10,000 printings | 0.2 | 0.1 | 5.2 | 1.9 | 1.6 |
| Cleaning performance | | Good | Good | Bad | Good | Good |
| Scattered toner recovery performance | | Good | Good | Bad | Bad | Bad |

As can be clearly seen from Table 1, in the case of the working example where the roller with its surface coated with either a fluorine resin or silicone resin was used and the difference in work functions (A−C) was greater than or equal to 0.1 eV, the surface of the recovering roller was negatively charged as with the polarity of negatively chargeable toner stored in the developing apparatus, and therefore scattered toner was likely to be attracted to the recovering roller and the recovery performance was excellent.

Since the surface of the recovering roller was coated with a resin, the van der Waals' force that acted between the recovering roller and the scattered toner was suppressed, and the scattered toner attached on the recovering roller was easily removed by the blade, exhibiting excellent cleaning performance. Therefore, even after the endurance test of 10,000 printings, the amount of scattered toner was 0.1 to 0.2 g, and the scattered toner could be recovered for a long period of time without reducing the recovery performance.

On the other hand, in the comparative example 1-1, since the surface of the recovering roller was positively charged, scattered toner was unlikely to be attracted thereto, and the recovery performance was poor compared to that of the working example. Since the surface of the recovering roller was not coated with a resin, the van der Waals' force acted between the recovering roller and the scattered toner, and the scattered toner attracted to the recovering roller was firmly attached on the recovering roller. Therefore it became more difficult for the blade to remove the scattered toner as the number of printed sheets increased. As a result, the surface of the recovering roller was coated with the scattered toner, and the recovery performance decreased.

In the comparative examples 1-2 and 1-3, the surface of the recovering toner was coated with a resin, and excellent cleaning performance was exhibited as a result. However, in the comparative example 1-2, the difference in the work functions (A−C) was −0.2 eV and the surface of the recovering toner was positively charged, while in the comparative example 1-3, the difference in the work functions (A−C) was 0.0 eV and the surface of the recovering toner was not charged. Therefore, the scattered toner was unlikely to be attracted to the recovering roller, and the scattered toner recovery performance was poor compared to that of the working example.

Examination 2

Working Example 2-1

With the exception that; a positively chargeable toner was stored in the developing apparatus instead of the negatively chargeable toner, an acrylic resin ("Almatex" manufactured by Mitsui Chemicals, Inc.) as shown in Table 2 was used as a resin for coating the surface of the recovering roller, and a DC bias voltage (+500 V) having a polarity the same as that of the toner (positive) was applied to the recovering roller, an endurance test was carried out as with the working example 1-1, and the amount of scattered toner was obtained to evaluate cleaning performance and scattered toner recovery performance. The results are shown in Table 2.

Working Example 2-2

Except for using a silicone resin ("AY42-170" manufactured by Dow Corning Toray Co., Ltd.) as the resin shown in Table, an endurance test was carried out as with the working example 2-1, and a scattered toner amount was obtained to evaluate cleaning performance and scattered toner recovery performance. The results are shown in Table 2.

Comparative Example 2-1

Except for not coating the surface of the recovering roller with a resin, an endurance test was carried out as with the working example 2-1, and a scattered toner amount was obtained to evaluate cleaning performance and scattered toner recovery performance. The results are shown in Table 2.

Comparative Example 2-2

Except for using a fluorine resin ("DL-902" manufactured by Du Pont-Mitsui Fluorochemicals Company, Ltd.) as the resin shown in Table 2, an endurance test was carried out as with the working example 2-1, and a scattered toner amount was obtained to evaluate cleaning performance and scattered toner recovery performance. The results are shown in Table 2.

Comparative Example 2-3

Except for using a silicone resin ("SR2510" manufactured by Dow Corning Toray Co., Ltd.) as the resin shown in Table 1, an endurance test was carried out as with the working example 2-1, and a scattered toner amount was obtained to evaluate cleaning performance and scattered toner recovery performance. The results are shown in Table 2.

TABLE 2

| | | Working examples | | Comparative examples | | |
|---|---|---|---|---|---|---|
| | | 2-1 | 2-2 | 2-1 | 2-2 | 2-3 |
| Resin | | Acrylic resin | Silicone resin | — | Fluorine resin | Silicone resin |
| Work function (B) of resin (eV) | | 5.3 | 5.2 | 4.7 | 5.7 | 5.5 |
| Work function (C) of blade (eV) | | 5.5 | 5.5 | 5.5 | 5.5 | 5.5 |
| Difference in work functions (B − C) (eV) | | −0.2 | −0.3 | −0.8 | 0.2 | 0.0 |
| Attachment force of scattered toner (nN) | | 5 | 5 | 60 | 5 | 5 |
| Scattered toner amount (g) | 0 printings | 0.0 | 0.0 | 0.0 | 0.0 | 0.0 |
| | 2,000 printings | 0.1 | 0.2 | 0.2 | 2.1 | 1.6 |
| | 4,000 printings | 0.2 | 0.1 | 0.5 | 1.9 | 1.8 |
| | 6,000 printings | 0.1 | 0.0 | 1.2 | 1.8 | 1.5 |
| | 8,000 printings | 0.3 | 0.1 | 2.1 | 1.9 | 2.1 |
| | 10,000 printings | 0.1 | 0.1 | 4.3 | 2.1 | 1.9 |
| Cleaning performance | | Good | Good | Bad | Good | Good |
| Scattered toner recovery performance | | Good | Good | Bad | Bad | Bad |

As can be clearly seen from Table 2, in the case of the working example where the roller with its surface coated with either an acrylic resin or silicone resin was used, and the difference in work function (B−C) was less than or equal to −0.1 eV, the surface of the recovering roller was positively charged as with the polarity of positively chargeable toner stored in the developing apparatus, and therefore scattered toner was likely to be attracted to the recovering roller and the recovery performance was excellent.

Since the surface of the recovering roller was coated with a resin, the van der Waals' force that acted between the recovering roller and the scattered toner was suppressed, and the scattered toner attached on the recovering roller was easily removed by the blade, exhibiting excellent cleaning performance. Therefore, even after the endurance test of 10,000 printings, the amount of scattered toner was 0.1 g, and the scattered toner could be recovered for a long period of time without reducing the recovery performance.

On the other hand, in the comparative example 2-1, the attachment force of the scattered toner was high and the surface of the recovering roller was positively charged. Consequently, the scattered toner was likely to be attracted to the recovering roller, and the scattered toner was efficiently recovered until when the endurance test reached approximately 2,000 printings. However, since the surface of the recovering roller was not coated with a resin, the van der Waals' force acted between the recovering roller and the scattered toner, and the scattered toner attracted to the recovering roller was firmly attached on the recovering roller. Therefore it became more difficult for the blade to remove the scattered toner as the number of printed sheets increased. As a result, the surface of the recovering roller was coated with the scattered toner, and the recovery performance decreased.

In the comparative examples 2-2 and 2-3, the surface of the recovering toner was coated with a resin and excellent cleaning performance was exhibited as a result. However, in the comparative example 2-2, the difference in the work functions (B−C) was 0.2 eV and the surface of the recovering toner was negatively charged, while in the comparative example 2-3, the difference in the work functions (B−C) was 0.0 eV and the surface of the recovering toner was not charged. Therefore, the scattered toner was unlikely to be attracted to the recovering roller, and the scattered toner recovery performance was poor compared to that of the respective working examples.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A developing apparatus comprising:

a developing roller; and a recovering roller that is arranged so as to oppose the developing roller, recovers scattered toner, and stores negatively chargeable toner, wherein the recovering roller has a surface coated with a fluorine resin or a silicone resin, and a blade positioned at the recovering roller and operable to remove the scattered toner, and a difference (A−C) between a work function (A) of the resin and a work function (C) of the blade is greater than or equal to 0.10 eV.

2. The developing apparatus according to claim 1, wherein the blade is made from urethane resin.

3. The developing apparatus according to claim 1, wherein a bias voltage having a polarity the same as that of the toner stored in the developing apparatus is applied to the recovering roller.

4. An image forming apparatus provided with the developing apparatus according to claim 1.

5. A developing apparatus comprising:

a developing roller; and a recovering roller that is arranged so as to oppose the developing roller, recovers scattered toner, and stores positively chargeable toner, wherein the recovering roller has a surface coated with an acrylic resin or a silicone resin, and a blade positioned at the recovering roller and operable to remove the scattered toner, and a difference (B−C) between a work function (B) of the resin and a work function (C) of the blade is less than or equal to −0.10 eV.

6. The developing apparatus according to claim 5, wherein the blade is made from urethane resin.

7. The developing apparatus according to claim 5, wherein a bias voltage having a polarity the same as that of the toner stored in the developing apparatus is applied to the recovering roller.

8. An image forming apparatus provided with the developing apparatus according to claim 5.

* * * * *